United States Patent [19]

Dahl et al.

[11] Patent Number: 4,651,478

[45] Date of Patent: Mar. 24, 1987

[54] GEODESIC MOLD HOUSE

[76] Inventors: Thomas R. Dahl, 4840 Santa Moncia Ave., Suite 1, San Diego, Calif. 92107; George Spector, 233 Broadway, RM 3615, New York, N.Y. 10007

[21] Appl. No.: 857,629

[22] Filed: Apr. 30, 1986

[51] Int. Cl.[4] ..... E04B 1/345

[52] U.S. Cl. ..... 52/2; 52/80; 52/81

[58] Field of Search ..... 52/2, 81, 80

[56] References Cited

U.S. PATENT DOCUMENTS 3,357,142 12/1967 Furrer et al. ..... 52/2
3,457,684 7/1969 Wood, Jr. ..... 52/2
4,077,177 3/1978 Boothroyd et al. ..... 52/2 X

FOREIGN PATENT DOCUMENTS 838446 4/1970 Canada ..... 52/2
519329 2/1957 Italy ..... 52/2
612449 11/1960 Italy ..... 52/2

OTHER PUBLICATIONS

Science News Letter, Jan. 2, 1960, "Sun-proof Igloo".

*Primary Examiner*—Alfred C. Perham

[57] ABSTRACT

A geodesic mold house is provided and consists in its final fabrication one hardened outer shell which is superimposed upon another shell with a space inbetween for insulation and utilizes reinforcement members for added strength.

7 Claims, 7 Drawing Figures

GEODESIC MOLD HOUSE

BACKGROUND OF THE INVENTION

The instant invention relates generally to prefabricated buildings and more specifically it relates to a geodesic mold house.

Numerous prefabricated buildings have been provided in prior art that are adapted to be assemblied together in specific segments. While these units may be suitable for the particular purpose to which they address, they would not be as suitable for the purposes of the present invention as heretofore described.

SUMMARY OF THE INVENTION

A principle object of the present invention is to provide a geodesic mold house that will overcome the shortcomings of the prior art devices.

Another object is to provide a geodesic mold house whereby in its final fabrication one hardened outer shell is superimposed upon another shell with a space inbetween for insulation.

An additional object is to provide a geodesic mold house that utilizes reinforcements rods and plates for added strength.

A further object is to provide a geodesic mold house that is simple and easy to use.

A still further object is to provide a geodesic mold house that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
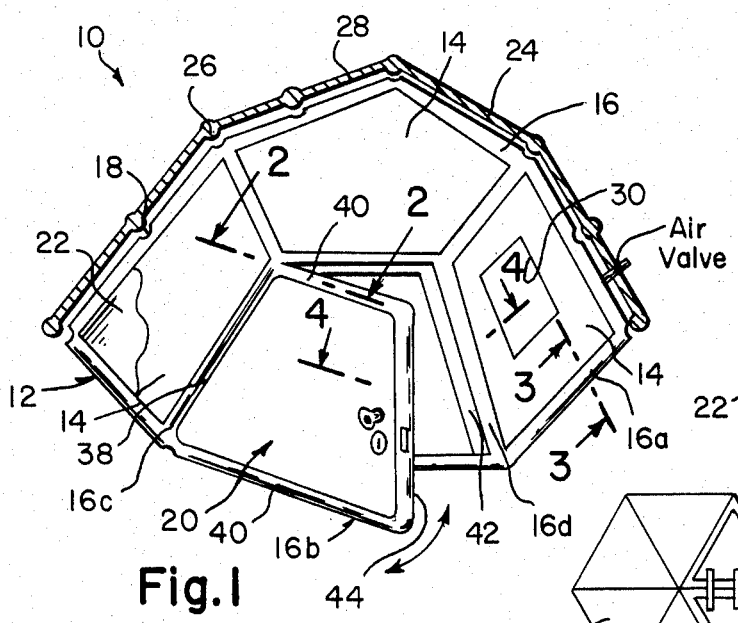
FIG. 1 is a perspective view of the invention with the outer shell in section.

Turning now descriptively to the drawings, in which similar reference characters denote similar elements throughout the several views, FIG. 1 illustrates a geodesic mold house 10 that consists of an inner flexible dome like shell 12 having a plurality of wall segments 14, inflatable ribs 16, indents 18 and a built-in door segment 20.

A coat of hardening material 22 is sprayed over the wall segments 14 and door segment 20 of the inner shell 12 to retain shape of the inner shell.

An outer firm dome like shell 24 having a plurality of detents 26 and being of the shape of the inner shell 12 is placed over the inner shell. The detents 26 will engage with the indents 18 creating a space 28 inbetween the shells for insulation through which windows 30 can be cut out through the shells.

Figure 3:
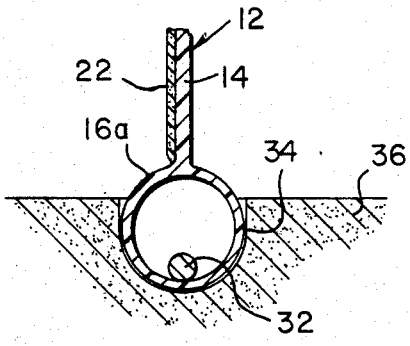
FIG. 3 is an enlarged cross sectional view taken along line 3—3 in FIG. 1 showing the bottom rib in greater detail.

A plurality of rods 32 are provided. FIG. 3 shows one of the rods 32 placed within one of the inflatable bottom ribs **16*a* of the inner shell 12 for weight so that the bottom rib 16*a* can be recessed securely within a ditch 34 in the ground 36**.

Figure 2:
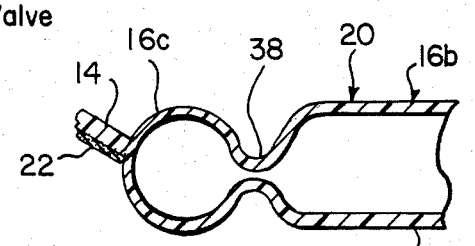
FIG. 2 is an enlarged cross sectional view taken along line 2—2 in FIG. 1 showing the door hinge in greater detail.

As shown in FIGS. 1 and 2 the built-in door segment 20 has a C-shaped inflatable rib **16*b* which is inflatably hinged at 38, at upper and lower portions 40, to one of the inflatable vertical ribs 16*c* on one of the wall segments 14 so that the door segment 20** can open and close.

Figure 4:
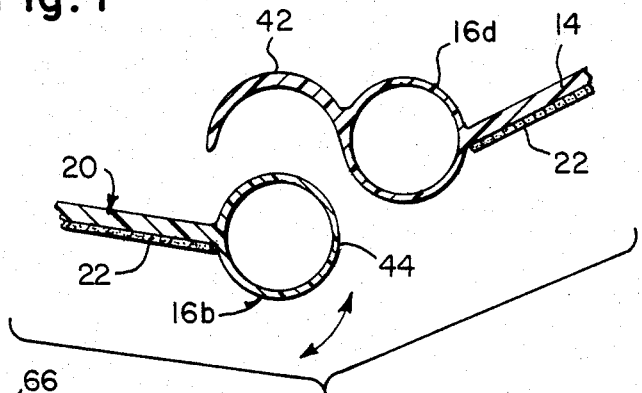
FIG. 4 is an enlarged cross sectional view taken along line 4—4 in FIG. 1 showing the stop member for the door in greater detail.

As shown in FIGS. 1 and 4 a curved stop member 42 is vertically connected to one of the inflatable vertical ribs **16*d*. The vertical portion 44 of the C-shaped rib 16*b* will engage with the stop member 42 when the door segment 20** is closed.

Figure 5:
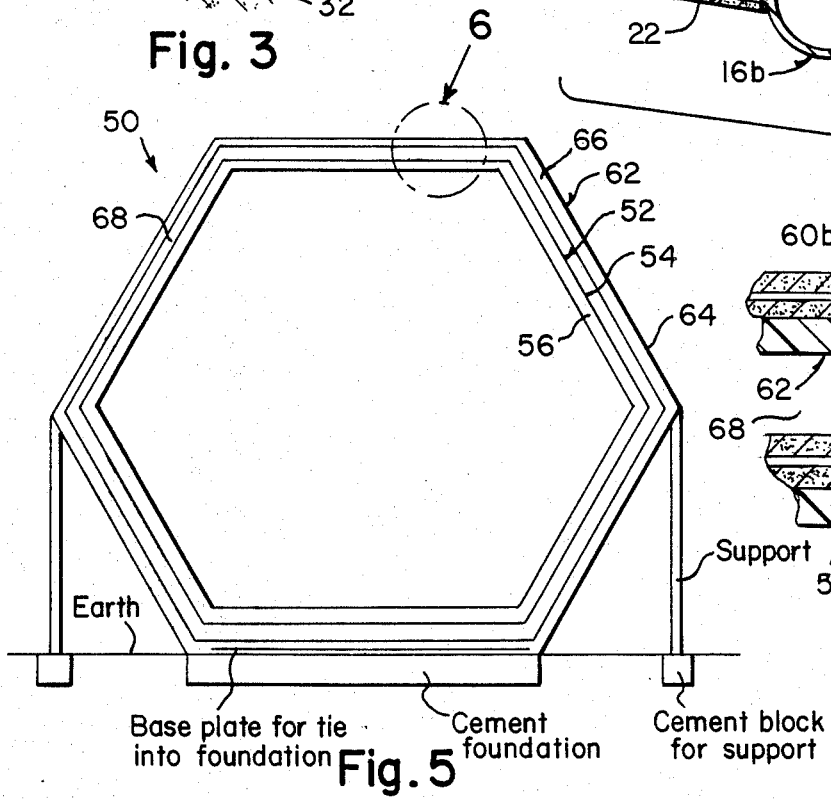
FIG. 5 is a diagrammatic cross sectional view of a modification of the invention.
Figure 6:
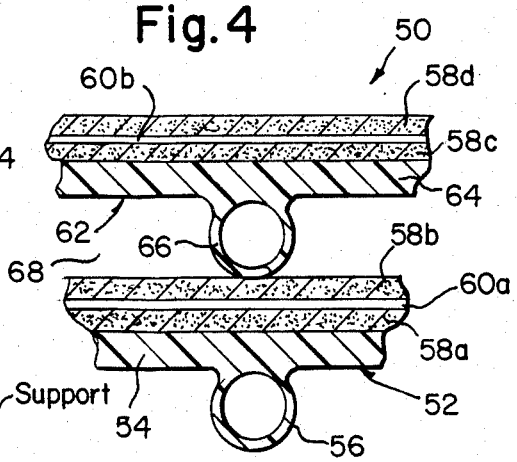
FIG. 6 is an enlarged cross sectional view as indicated by numeral 6 in FIG. 5.

FIGS. 5 and 6 show a modified geodesic mold house 50 which consists of an inner flexible bag like shell 52 having a plurality of wall segments 54 and inflatable ribs 56.

A first coat **58*a* of hardening material is sprayed on the wall segments 54 of the inner shell 52** to retain shape of the inner shell.

A first set of reinforcement rods **60*a* for reinforcing the wall segments 54 of the inner shell 52 are placed onto the first coat 58*a*** of hardening material.

A second coat **58*b* of hardening material is sprayed on the wall segments 54 of the inner shell 52 so that the reinforcement rods 60*a*** will be within the hardening materials to add strength thereto.

An outer flexible bag like shell 62 is also provided and has a plurality of wall segments 64 and inflatable ribs 66 being of the shape of the inner shell 52. The outer shell 62 is placed around the inner shell 52 so that a space 68 is created inbetween the shells for insulation.

A third coat **58*c* of hardening material is sprayed on the wall segments 64 of the outer shell 62** to retain shape of the outer shell.

A second set of reinforcement rods **60*b* for reinforcing the wall segments 64 of the outer shell 62 are placed onto the third coat 58*c*** of hardening material.

A fourth coat **58*d* of hardening material 16 sprayed on the wall segments 64 of the outer shell 62 so that the reinforcement rods 60*b*** will be within the hardening materials to add strength thereto.

Figure 7:
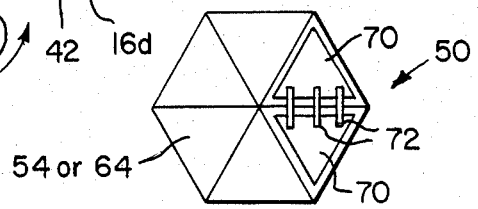
FIG. 7 is a diagrammatic side view of another modification showing metal reinforcement sheets with tie-ins to replace the steel reinforcement rods.

In FIG. 7 a plurality of reinforcement plates 70 and a plurality of tie down strips 72 therebetween are used instead of the reinforcement rods **60*a* and 60*b***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A geodesic mold house which comprises:

(a) an inner flexible dome like shell having a plurality of wall segments, inflatable ribs, indents and a built-in door segment;

(b) a coat of hardening material sprayed over said wall segments and door segments of said inner shell to retain shape of said inner shell; and (c) an outer firm dome like shell having a plurality of detents and being of the shaped of said inner shell, said outer shell placed over said inner shell in which said detents will engage with said indents creating a space inbetween said shells for insulation through which windows can be cut out through said shells.

2. A geodesic mold house as recited in claim 1, further comprising a plurality of rods, each said rod placed within one of said inflatable bottom ribs of said inner shell for weight so that said bottom ribs can be recessed securely within a ditch in the ground.

3. A geodesic mold house as recited in claim 2, wherein said built-in door segment having a C-shaped inflatable rib is inflatably hinged at upper and lower portions to one of said inflatable vertical ribs on one of said wall segments so that said door segment can open and close.

4. A geodesic mold house as recited in claim 3, further comprising a curved stop member vertically connected to one of said inflatable vertical ribs so that said vertical portion of said C-shaped rib will engage with said stop member when said door segment is closed.

5. A geodesic mold house, which comprises:

(a) an inner flexible bag like shell having a plurality of wall segments and inflatable ribs;

(b) a first coat of hardening material sprayed on said wall segments of said inner shell to retain shape of said inner shell;

(c) a first means for reinforcing said wall segments of said inner shell placed onto said first coat of hardening material;

(d) a second coat of hardening material sprayed on said wall segments of said inner shell so that said reinforcing means will be within said hardening materials to add strength thereto;

(e) an outer flexible bag like shell having a plurality of wall segments and inflatable ribs being of the shape of said inner shell and placed around said inner shell so that a space is created inbetween said shells for insulation;

(f) a third coat of hardening material sprayed on said wall segments of said outer shell to retain shape of said outer shell;

(g) a second means for reinforcing said wall segments of said outer shell placed onto said third coat of hardening material; and (h) a fourth coat of hardening material sprayed on said wall segments of said outer shell so that said reinforcing means will be within said hardening materials to add strength thereto.

6. A geodesic mold house as recited in claim 5, wherein said first and second reinforcing means includes a plurality of reinforcement rods.

7. A geodesic mold house as recited in claim 5, wherein said first and second reinforcing means includes a plurality of reinforcement plates and a plurality of tie down strips therebetween.

* * * * *